United States Patent [19]

Compton

[11] 4,218,309

[45] Aug. 19, 1980

[54] REMOVAL OF SULFUR FROM SHALE OIL

[75] Inventor: Leslie E. Compton, Claremont, Calif.

[73] Assignee: Occidental Research Corporation, Irvine, Calif.

[21] Appl. No.: 940,867

[22] Filed: Sep. 8, 1978

[51] Int. Cl.[2] ..... C10G 31/06

[52] U.S. Cl. ..... 208/208 R; 208/11 R; 166/251; 166/256; 166/259; 166/267; 299/6

[58] Field of Search ..... 208/208 R, 11 R, 211

[56] References Cited

U.S. PATENT DOCUMENTS

| | | | |
|---|---|---|---|
| 2,315,843 | 4/1943 | Drennan et al. | 208/208 R |
| 2,414,963 | 1/1947 | McConnell | 208/208 R |
| 3,284,336 | 11/1966 | Culbertson, Jr. et al. | 208/11 R |
| 3,341,448 | 9/1967 | Ford et al. | 208/211 |
| 3,994,343 | 11/1976 | Cha et al. | 208/11 R |
| 4,007,963 | 2/1977 | Ridley | 208/11 R |
| 4,125,157 | 11/1978 | Ridley | 208/11 R |
| 4,126,180 | 11/1978 | Cha | 208/11 R |

*Primary Examiner*—George Crasanakis
*Attorney, Agent, or Firm*—Christie, Parker & Hale

[57] ABSTRACT

Crude shale oil produced by in situ retorting of oil shale can contain from about 1 to 2% sulfur by weight, the sulfur being distributed widely through the lower and higher boiling fractions of the shale oil. Substantially non-condensible sulfur containing gas such as hydrogen sulfide is evolved from such crude shale oil by maintaining such shale oil at an elevated temperature in the substantial absence of added reagent, with the maximum temperature below thermal decomposition temperatures of such shale oil for sufficient time to lower the sulfur content of the shale oil.

22 Claims, 2 Drawing Figures

REMOVAL OF SULFUR FROM SHALE OIL

BACKGROUND

The presence of large deposits of oil shale in the Rocky Mountain region of the United States has given rise to extensive efforts to develop methods for recovering shale oil from kerogen in formations containing oil shale. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbonaceous product is called "shale oil". Liquid products from an in situ oil shale retort can also include water which appears as a separate phase or as a complex emulsion of crude shale oil and water. "Crude shale oil" is a term used herein for shale oil withdrawn from a fragmented permeable mass of formation particles in an in situ oil shale retort without further processing, except such processing as may be required for separating crude shale oil from water. Such processing can include heating of the crude shale and water, such as an emulsion of crude shale oil and water, to about 150° F. or more for about a day, addition of minor amounts of emulsion breaking materials, or both.

A number of methods have been proposed for processing the oil shale which involve either mining the kerogen-bearing shale and processing the oil shale above ground or processing the oil shale in situ. The latter approach is preferable from the standpoint of environmental impact, since the treated oil shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by fragmenting such formation to form a stationary, fragmented permeable mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as an oxygen-supplying gaseous combustion zone feed to advance the combustion zone through the retort. In the combustion zone, oxygen in the combustion zone feed is depleted by reaction with hot carbonaceous materials to produce heat, combustion gas, and combusted oil shale. By the continued introduction of the retort inlet mixture into the retort, the combustion zone is advanced through the fragmented mass in the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products, including gaseous and liquid hydrocarbonaceous products, and to a residual solid carbonaceous material. Residual carbonaceous material in the retorted oil shale provides fuel for advancing the combustion zone through the retorted oil shale.

The liquid products and gaseous products are cooled by the cooler oil shale fragments in the retort on the advancing side of the retorting zone. The liquid hydrocarbonaceous products together with water produced in or added to the retort, are collected at the bottom of the retort. The liquid hydrocarbonaceous products are separated from the water in the liquid product stream as crude shale oil. An off gas containing combustion gas, including carbon dioxide generated in the combustion zone, gaseous products produced in the retorting zone, carbon dioxide from carbonate decomposition, and any gaseous retort inlet mixture that does not take part in the combustion process, is also withdrawn from the bottom of the retort.

Kerogen contains appreciable amounts of sulfur, and such sulfur can appear in hydrocarbonaceous materials such as crude shale oil. Sulfur can also be present in an in situ retort in mineral sulfides such as pyrite. Some sulfur is withdrawn from the in situ retort as hydrogen sulfide or other sulfurous gases in the off gas. An appreciable amount of the sulfur, however, can be present in the crude shale oil from an in situ retort, often exceeding about one percent by weight. It is desirable to remove sulfur from crude shale oil since it is a contaminant which can have adverse effects in subsequent use or processing of the crude shale oil. For example, if the crude shale oil is used directly as a burner feed, sulfur can appear in the combustion gas and must be scrubbed before released to the environment. It is also desirable to have a low sulfur crude oil for refinery or petrochemical feed stocks.

Many processes have been described for removing sulfur from liquid hydrocarbonaceous fuels. Many such processes involve selective oxidation of sulfur compounds with oxygen or nitrogen oxides. After oxidation, a thermal decomposition step may be practiced at temperatures above about 200° C. to insure that substantially all of the gaseous decomposition products are given off. Sulfur is liberated mainly as sulfur dioxide, although at higher temperatures in the region of 300° C. and over increasing quantities of hydrogen sulfide are also liberated. Such a process is described, for example, in U.S. Pat. No. 3,341,448 by Ford et al. Such treatment is applied to oil treated by oxidation rather than untreated crude shale oil.

Other processes involve catalytic hydro-desulfurization in the presence of elemental hydrogen to produce volatile hydrogen sulfide, which is removed from the liquid fuel. U.S. Pat. No. 3,106,521 by Huntington describes a method for producing shale oil having a low sulfur content which involves retorting oil shale in an atmosphere of hydrogen at high temperatures and pressures of about 15 to 30 atmospheres and catalytically hydrofining volatile products of retorting at 15 to 30 atmospheres pressure. In the hydrofining step, sulfur is converted to gaseous hydrogen sulfide which is removed when the hydrofining product is condensed to the liquid state.

According to U.S. Pat. No. 3,919,402, by Guth et al, which relates to desulfurization of petroleum, certain petroleums such as Beaumont Oil can be desulfurized by passage through a still at temperatures on the order of 300° to 500° F. to remove sulfur as hydrogen sulfide. This is stated to be a special characteristic of Beaumont Oil; not all petroleums give off hydrogen sulfide upon heating.

In *Petroleum Refining Engineering* by W. Nelson, Second Edition, McGraw Hill Book Company, Inc., New York, 1941, page 606, it is stated that most sulfur compounds are decomposed by heating to 700° to 750° F. in the presence of bauxite, and a process is described in which sulfur is removed from gasoline vapor at about 645° F. and a pressure of 50 pounds per square inch in the presence of a hydrated silicate of alumina catalyst which contains oxides of nickel, cobalt, and other metals. However, the catalyst is subject to poisoning in a period of three to ten hours and must periodically be regenerated.

U.S. Pat. No. 3,284,336 by Culbertson et al describes a method for reducing pour point of shale oil by fractionating the oil to obtain a light fraction and an oil residue, heat treating the oil residue at a temperature above about 600° F. and below the point of incipient thermal decomposition of the residue. The heat treated residue is recombined with the light fraction to result in an oil having a pour point lower than that of the original crude oil. The desired modification of the heavy fraction is effected without formation of appreciable amounts of non-condensible gases. Temperatures are preferably 600° F. (315° C.) to 800° F. (427° C.). No mention is made of treating the crude shale oil for reducing sulfur content.

Other references concerning sulfur in petroleum include U.S. Pat. Nos. 1,935,207 by Harder et al; 1,968,842 by Malisoff; 2,489,316 by Proell; 2,489,318 by Proell; 2,505,910 by Proell et al; 2,573,674 by Adams et al; 2,581,050 by Smedslund; 2,598,013 by Proell et al; 2,598,014 by Proell et al; 2,702,824 by Wetterholm; 2,825,744 by Smedslund; 2,825,745 by Smedslund; 3,135,680 by Fierce et al; 3,164,546 by Millikan et al; 3,244,618 by Diamond et al; 3,267,027 by Fierce et al, 3,294,677 by Martin et al; 3,847,800 by Guth et al; 3,953,180 by Hoffert et al; and 3,975,303 by Eyles et al.

The need for low sulfur fuels is great and increasing. Moreover, the importance of shale oil as fuel is expected to increase steadily as the cost of pretroleum rises and the supply dwindles. Consequently, reliable, low cost methods of removing sulfur from shale oil are needed.

SUMMARY OF THE INVENTION

In accordance with the present invention, sulfur is removed from crude shale oil by maintaining such shale oil, in the substantial absence of added reagent at temperatures below thermal decomposition temperatures of such shale oil for a sufficient time to evolve substantially non-condensible sulfur-containing gas from the shale oil, whereby the sulfur content of the shale oil is lowered.

In an embodiment of this invention, shale oil is produced by advancing a combustion zone through a fragmented permeable mass of formation particles containing oil shale in an in situ oil shale retort in a subterranean formation containing oil shale. Kerogen in oil shale in a retorting zone on the advancing side of the combustion zone is decomposed to produce gaseous and liquid products including shale oil, the shale oil containing sulfur. Liquid products including shale oil and water, such as an emulsion of shale oil and water, are withdrawn from the retort, shale oil is separated from such water, and sulfur is removed from such separated shale oil by thermally reacting the separated shale oil in the substantial absence of added reagent.

DRAWINGS

FIG. 1 illustrates schematically in vertical cross section an in situ oil shale retort for producing shale oil; and FIG. 2 is a graph of the sulfur content of shale oil from such an in situ oil shale retort as a function of heating at various temperatures for periods of one or eight hours at a pressure of about one atmosphere under reflux conditions which prevent the loss of volatile, condensible constituents of the shale oil.

DETAILED DESCRIPTION

Briefly, this invention concerns removing sulfur from crude shale oil. Sulfur is removed as non-condensible sulfur containing gas by reacting such crude shale oil in the substantial absence of added reagent, such as elemental hydrogen. Thus, crude shale oil can be reacted by heating, preferably under conditions which limit or avoid the loss of volatile, condensible components of the shale oil. Such crude shale oil can be produced in an in situ oil shale retort.

Figure 1:
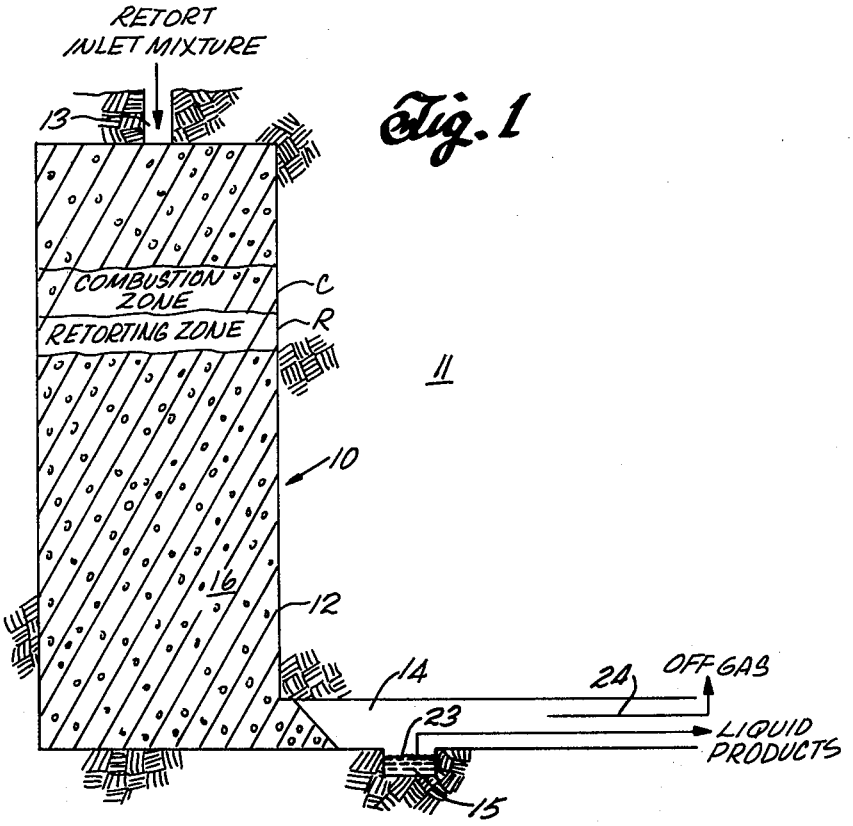

FIG. 1 illustrates schematically in vertical cross-section an in situ oil shale retort 10 in a subterranean formation 11 containing oil shale, the retort being in an intermediate stage of retorting with a retorting zone R in a mid-portion of the retort. The in situ oil shale retort comprises a cavity 12 containing a fragmented permeable mass 16 of formation particles containing oil shale.

The cavity 12 can be created simultaneously with fragmentation of the mass 16 of formation particles contained therein by blasting by any of a variety of techniques. A desirable technique involves excavating a void within the in situ oil shale retort site and explosively expanding remaining oil shale in the site toward the void. Methods of forming an in situ oil retort are described in above-mentioned U.S. Pat. Nos. 3,661,423; 4,043,595; 4,043,596; 4,043,597; and 4,043,598. A variety of other techniques can also be used.

The total volume of the excavated void or voids is less than about 30% of the total volume of the retort being formed, preferably in the range of about 10 to 25%. When formation is fragmented, the excavated void volume becomes distributed throughout the resulting fragmented mass, providing a fragmented mass of high permeability and low resistance to gas flow.

One or more gas conduits 13 are provided in communication with an upper portion of the fragmented mass of particles containing oil shale in the in situ retort. During retorting operations, air or other oxygen-containing gas is introduced to an upper portion of the fragmented mass to supply oxygen for combustion. The air can be enriched with oxygen, or can be diluted with off gas recycled from an in situ oil shale retort or with other combustible or inert gas so that the oxygen concentration in the processing gas introduced into the fragmented mass is lower than the oxygen concentration of the air.

A drift 14 or the like is in fluid communication with a lower portion of the fragmented permeable mass in the in situ retort. In the embodiment illustrated schematically in FIG. 1, the drift contains a sump 15 in which liquid products 23 of retorting, including crude shale oil withdrawn from the fragmented mass, are collected. Both crude shale oil and water are withdrawn from the sump and can be processed as required for separation of the crude shale oil and water. Crude shale oil can be withdrawn from an in situ oil shale retort in the form of an emulsion of shale oil and water. It is preferable to separate the crude shale oil from such an emulsion before treating the crude shale oil for removing sulfur in accordance with practice of this invention. Separation of the shale oil from the water avoids consumption of energy in vaporization of water during the heating of the crude shale oil. This can also avoid steam distillation of hydrocarbonaceous constituents of the crude shale oil. Removal of water also permits reaching higher temperatures when the shale oil is heated under reflux conditions. Such emulsion can be separated by holding at a temperature of at least 120° F. for at least about one day. Additional drying of the crude shale oil can also be desirable.

Off gas 24 is also withdrawn from a lower portion of the fragmented mass in the in situ oil shale retort by way of the drift 14. Such off gas includes gaseous products of retorting.

Crude shale oil which can be treated in accordance with this invention can be produced by processes described in the above-mentioned patents. Methods of operating an in situ oil shale retort are also described, for example, in U.S. Pat. No. 4,036,299, which is incorporated herein by this reference.

At the start of the retorting operation, a portion of the fragmented permeable mass at location in an upper portion of the in situ oil shale retort is ignited for establishing a combustion zone C in the fragmented mass. After a combustion zone is established in the fragmented mass, an oxygen supplying gas is introduced to burn carbonaceous material in the oil shale and sustain the combustion zone. Gas flow through the combustion zone C causes the combustion zone to advance downwardly through the fragmented mass as carbonaceous material in the oil shale is burned. Heat of combustion is transferred from the combustion zone downwardly by flowing gas to establish and advance a retorting zone R on the advancing side of the combustion zone. The heat of combustion raises the temperature of particles containing oil shale in the retorting zone to a retorting temperature such as about 900° F. or higher. Kerogen in oil shale in the retorting zone is decomposed to produce gaseous and liquid hydrocarbonaceous products including crude shale oil.

Hydrocarbonaceous materials produced by decomposition of kerogen in the retorting zone advance through a zone of elevated temperature in the fragmented mass on the advancing side of the retorting zone. In the portion of the fragmented mass on the advancing side of the retorting zone, the liquid or liquefiable hydrocarbons are subjected to conditions that can affect their properties before reaching the bottom of the fragmented mass. As an indication of the temperature adjacent gas flow paths in an in situ oil shale retort retorted according to processes as described above, the temperature of off gas withdrawn from an in situ oil shale retort can exceed 100° F. in a short time (e.g., ten days to two weeks) after a combustion zone is established. One set of measurements of temperature indicated an elapsed time of about one month for a temperature increase of a location in the retort from about 150° to about 350° F. The rate of advance of the retorting zone through the fragmented mass in the in situ oil shale retort can be less than about 1.2 feet per day. Consequently, an active in situ oil shale retort can be undergoing retorting for a considerable period of time. For example, a retort about 270 feet high has been retorted over a period of five and one-half months.

Since an operating in situ oil shale retort as provided in practice of this invention is tall, for example a few hundred feet tall, hydrocarbonaceous liquids percolating through the fragmented permeable mass on the advancing side of the retorting zone can have a long residence time in the fragmented mass. The fragmented mass also has a substantial surface area on particles over which liquid hydrocarbonaceous materials can flow. Thus, the path length through the fragmented mass traversed by hydrocarbonaceous materials between the retorting zone and the location where crude shale oil is withdrawn from the fragmented mass can be quite long. As retorting continues, the path length through the fragmented mass traversed by hydrocarbonaceous materials between the retorting zone and the location where crude shale oil is withdrawn progressively decreases and conditions in the fragmented mass on the advancing side of the retorting zone change.

Crude shale oil produced by in situ retorting by processes as hereinabove described can be treated in accordance with practice of this invention. As an example of such a process, an in situ oil shale retort about 120 feet square in horizontal cross section, and about 270 feet high was prepared in a southern part of the Piceance Creek Basin region of Colorado. The in situ retort, identified as Retort 4, contained a fragmented permeable mass of particles of formation containing oil shale having an average Fischer Assay of less than about 15 gallons per ton.

An upper portion of the fragmented mass in the in situ oil shale retort was ignited by introducing air and LPG and burning the resultant mixture. This raised a substantial portion of the particles in the upper portion of the fragmented mass to an ignition temperature and establishing a combustion zone. Oxygen containing gas was introduced to an upper portion of the fragmented mass in the retort for advancing the combustion zone downwardly through the fragmented mass. Off gas was withdrawn from a lower portion of the fragmented mass and the resultant flow of gas downwardly through the in situ retort carried heat of combustion downwardly from the combustion zone into a retorting zone.

Thermal decomposition of kerogen in oil shale in the retorting zone yielded gaseous and liquid hydrocarbonaceous products. Crude shale oil and water were withdrawn from the bottom of the fragmented mass in the retort. The off gas withdrawn from the bottom of the retort included gaseous products.

Such retorting operation was conducted in the Retort 4 for about five and one-half months, during which time the retorting zone advanced downwardly through more than 200 feet of the fragmented mass in the retort. It is calculated that the average rate of advancement of the retorting zone in the retort was about 1.2 feet per day.

Three other in situ oil shale retorts have been prepared in the Piceance Creek Basin and retorted by generally similar techniques. These in situ oil shale retorts are identified as Retorts 1, 2, and 3, respectively. Each of these retorts had a square horizontal cross section of about 1000 square feet. Retort 1 had a height of about 94 feet. Retort 3 had a height of about 113 feet. Each of the retorts contained a fragmented permeable mass of particles containing oil shale. Most of the length of the fragmented mass in each retort was retorted by processes as described herein.

Shale oil produced by in situ retorting as described above contains sulfur in amounts varying from about 0.5 to 2 weight percent as determined according to ASTM method D-129. The sulfur is distributed fairly evenly throughout the various distillation fractions of the oil. Table I presents a summary of the results of fractional distillation analysis of a number of samples of crude shale oil from an in situ oil shale retort.

TABLE I

Fractional Distillation of Crude Shale Oils

| Distillation ASTM D-1160, Corrected Weight Percent Over | Temperature Spread, °F. |
|---|---|
| IBP* | 374–453 |
| 10% | 495–657 |
| 20% | 549–725 |
| 30% | 588–792 |
| 40% | 631–849 |
| 50% | 684–907 |
| 70% | 741–1062 |

Average % over at 400° F. = 0
Average % over at 480° F. = 3.0
Average % over at 600° F. = 13.0
*IPB = Initial Boiling Point Sulfur content of crude shale oil produced by in situ retorting as described above can be reduced through evolution of sulfur-containing gas by reacting the crude shale oil in the substantial absence of added reagent such as elemental hydrogen or oxygen. The reaction by which the sulfur-containing gas is evolved can be accelerated to a practical rate by heating crude shale oil in the absence of added catalyst or added reagent.

In an embodiment of this process, crude shale oil withdrawn from an in situ oil shale retort is maintained, in the substantial absence of added reagent, notably in the absence of added elemental hydrogen or oxygen, at temperatures below thermal decomposition temperatures of the shale oil for evolving substantially non-condensible sulfur-containing gas from the shale oil. Reaction of the crude shale oil to evolve non-condensible sulfur-containing gas occurs in the substantial absence of added reagent. The evolution is in response to the stimulus of maintaining the temperature of the crude shale oil above about 100° C. The effect is an auto-reaction occurring without addition of reagents or reactive materials to the crude shale oil. Reagents are regarded as materials that react with the crude shale oil as contrasted with materials that are substantially inert. Crude shale oil is made up of many unidentified consitutents which can spontaneously change or inter-react in response to elevated temperature. Oxygen or air is preferably substantially excluded from the crude shale oil while it is maintained at elevated temperature for evolving sulfur containing gas. A reason for this is the explosion or fire hazard that can be encountered. The flash point for shale oil from an in situ oil shale retort is in the order of from about 180° to 250° C., and substantial amounts of oxygen could be hazardous. Undue oxidation of the oil is also to be avoided.

At ambient pressures of about one atmosphere, and at boiling temperatures of shale oil, the presence of elemental hydrogen in contact with the crude shale oil does not appear to have any significant effect. The sulfur content of the crude shale oil is reduced to about one half percent in either the presence or absence of hydrogen. Hydrogen, under these conditions, is therefore not considered a reagent since it does not appear to react significantly with sulfur in the crude shale oil. Hydrogen can be used as a sweep gas for carrying evolved sulfur-containing gases away from the shale oil.

The temperature at which the shale oil is maintained and the time of heating are maintained below conditions at which thermal decomposition of the shale oil can occur. That is, at conditions which result in substantial formation of char, or appreciable rupture of carbon-carbon bonds in the crude shale oil. The crude shale oil is maintained at temperatures below which appreciable cracking of the shale oil occurs.

The crude shale oil is preferably maintained at temperatures greater than about 100° C. for evolving substantially noncondensible sulfur-containing gas and reducing sulfur content of the shale oil. Short times at 100° C. reduce the sulfur content a rather limited extent, and prolonged heating can be required for effective sulfur reduction. Below about 100° C. the reduction of sulfur content is too low to be economical. In one test of a crude shale oil, maintaining the temperature at 60° C. for 75 days caused little, if any reduction in sulfur content of the crude shale oil.

The crude shale oil can be heated at temperatures up to about 400° C. for short periods without substantial thermal decomposition of the shale oil. Temperatures higher than about 400° C. can result in substantial cracking of the shale oil. Both time and temperature of heating are selected to avoid undesirable thermal decomposition. For example, maintaining the crude shale oil at a temperature approaching 400° C. for an extended period of time such as about 25 hours, can cause some thermal decomposition.

Preferably, the crude shale oil is maintained at temperatures in the range of from about 200° to 350° C. for substantial reduction of the sulfur content. Heating at 200° C. for eight hours can remove about ¼ of the sulfur content of the crude shale oil. Such mild heating causes little change in other properties of the shale oil and effects a substantial improvement in sulfur content. Maintaining the oil at temperatures below about 200° C. for sulfur removal can involve appreciable time intervals for significant sulfur reduction and require large storage capacity for practical operations. Preferably, the maximum temperature at which the shale oil is maintained is less than about 350° C. to minimize deleterious changes in other properties of the shale oil.

When the shale oil is maintained at elevated temperature for reducing sulfur content, changes can occur in the pour point of the shale oil. Thus, for example, a shale oil having an initial pour point of about 30° F. (−1° C.) showed an increase in pour point when maintained at elevated temperature for about eight hours. When maintained at about 100° C. for such a period, the pour point had increased to about 40° F. (4° C.). When held at 300° C. for eight hours, the pour point increased to about 55° F. (13° C.). After eight hours heating at 300° C., the pour point of a crude shale oil sample was about 75° F. (24° C.).

The time that the crude shale oil is maintained at elevated temperatures for sulfur reduction is preferably in the range of from about 0.1 to 100 hours, and preferably in the range of from about 1 to 10 hours. When the time at elevated temperature is less than about 0.1 hours, no more than trivial amounts of sulfur appear to be removed from the shale oil. Preferably, the shale oil is maintained at elevated temperature for at least about 1 hour to give adequate time for hydrogen sulfide and/or other sulfur-containing gases to evolve. Time can be minimized by spraying, agitating, or making a thin film of the crude shale oil to enhance the ability of the sulfur-containing gas to escape from the liquid. Appreciable time at elevated temperature is still needed, however, for the sulfur reducing reactions to occur.

Heating times greater than about 100 hours have little additional effect on sulfur removal, and require substantial facilities for handling large quantities of elevated temperature shale oil. Such cost penalties are to be avoided. It is preferred that the time that the shale oil is maintained at elevated temperature is less than about 10 hours to minimize facilities cost, and since it appears that further reductions in sulfur content are limited, at least for temperatures greater than about 200° C.

Thus, it is preferred that the crude shale oil be maintained at a temperature in excess of about 100° C. for a sufficient time to reduce the sulfur content of the shale oil. Such a time is in the range of from about 0.1 to 100 hours, and the maximum temperature is below temperatures at which substantial thermal decomposition of the shale oil occurs, or about 400° C. Preferably, the crude shale oil is maintained in the temperature range of from about 200° to 350° C. for about 1 to 10 hours for removal of a substantial portion of the sulfur content of the crude shale oil.

Preferably, crude shale oil is maintained at temperatures greater than about 100° C. until the sulfur content is reduced to about one-half percent. Various tests have indicated that sulfur content can be reduced to about this level by maintaining the shale oil at an elevated temperature. Thus, for example, heating at several hundred degrees reduced the sulfur content of a sample to about 0.55%. Heating for 48 hours at about 320° C. reduced the sulfur content of a shale oil sample from about 1.00% to about 0.57%. A sample of shale oil having a sulfur content of 0.52% was unchanged after eight hours of refluxing at 250° C.

The analytical technique employed for these tests (ASTM D-129) has an accepted deviation from laboratory to laboratory of about 0.09 percent by weight. The repeatability within one laboratory can be appreciably less. Continued heating in the substantial absence of added reagent does not appear to be effective once the sulfur content of the crude shale oil is reduced to about one-half percent by weight.

Low boiling hydrocarbonaceous components of the crude shale oil can be distilled off when the shale oil is maintained at elevated temperatures. To prevent loss of such components, a crude shale oil should be maintained at elevated temperature under conditions equivalent to reflux conditions. Thus, for example, the crude shale oil can be heated in a vessel equipped with a water cooled reflux condenser. Alternatively, low boiling components can be separately condensed and recycled. Thus, the crude shale oil is maintained at elevated temperature under conditions which permit non-condensible gaseous components to be evolved and removed while retaining liquid components in the shale oil.

It is desirable to reduce the sulfur content of crude shale oil after separating the crude shale oil from water so that the shale oil is substantially dry. Unless the crude shale oil is separated from water, elevated temperatures in excess of about 100° C. cannot be easily achieved. Crude shale oil can be heated at moderate temperatures less than about 100° C., with or without vacuum, to remove light ends and water from the oil. The presence of light ends also can limit temperatures to which oil can be heated under conditions equivalent to reflux. Thereafter, the crude shale oil is maintained at a temperature in excess of about 100° C. under conditions equivalent to reflux for a sufficient time to reduce the sulfur content of the shale oil.

Shale oil that is not completely dry can be treated for sulfur removal by maintaining the shale oil under sufficient pressure to prevent boiling as it is heated. Pressurizing can also avoid removal of light ends and subject them to heating for sulfur removal. Nominal pressures of inert gas can be used while keeping the partial pressure of sulfur-containing gas low. Inert gas can be bubbled through the shale oil to aid in sweeping sulfur-containing gas from the liquid. Pressurizing the shale oil as it is maintained at elevated temperature produces a result similar to reflux without heat loss by vaporization of part of the shale oil.

The mechanism or mechanisms involved in the evolution of the sulfur-containing gas have not been identified. However, it is clear that a chemical reaction is involved, because more sulfur is lost than can be attributed to loss of dissolved sulfurous gases such as hydrogen sulfide in the oil or to loss of light ends by simple distillation. Substantial loss of sulfur occurs when crude shale oil is heated in a flask equipped with a water-cooled reflux condenser that prevents the escape of condensible, low boiling constituents of the oil. The lost sulfur is evolved in the form of a non-condensible gas, that is, a gas which does not condense in a water-cooled condenser at ambient pressure. It can be seen by reference to Table 1 that even the lowest boiling fraction of the crude shale oil is condensible under such conditions.

Without wishing to be bound by a particular theory, several possible mechanisms can be postulated to account for the loss of sulfur. One such mechanism postulates the transfer of hydrogen from a partially hydrogenated polycyclic aromatic compound such as tetralin to primary alkyl mercapto groups with the resultant liberation of hydrogen sulfide and the conversion of the tetralin, for example, to naphthalene. Such a mechanism has been well documented in the coal liquefaction art. Metal carbonyls such as $Cr(CO)_6$ and $CO_2(CO)_{10}$ can catalyze such a hydrogen transfer reaction. Such a reaction can proceed in accordance with the following illustrative steps (which are not complete, balanced equations):

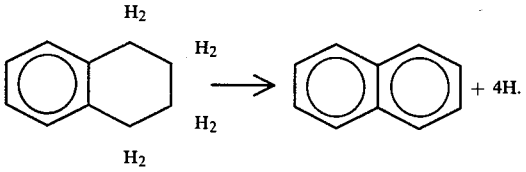

I $$CH_3(CH_2)_nCH_2SH + 2H \longrightarrow CH_3(CH_2)_nCH_3 + H_2S \qquad \text{II}$$

Another mechanism can involve an intramolecular cyclization reaction in which a molecule such as 4-mercaptobutylbenzene loses hydrogen sulfide and forms a second ring. Such a reaction could proceed as shown in Equation III:

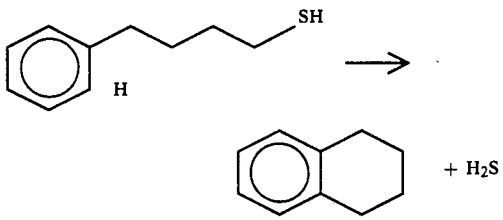

III

A third mechanism can be relatively low-temperature thermal cracking of sulfur-containing molecules with the liberation of volatile sulfur-containing products. Such cracking reactions can be catalyzed by known hydrocarbon cracking catalysts. Kerogen in oil shale appears to be a large polymer with heterogeneous cross linking. One of the major linking entities appears to be sulfur and sulfur-carbon bonds can persist in crude shale oil. The energy of the carbon-sulfur single bond is about 65 kilocalories per gram mole, adn the carbon-carbon bond has an energy of about 83 kilocalories per gram mole. Thus, carbon-sulfur bonds can be susceptible to rupture under conditions that do not induce large scale cracking of carbon-carbon linkages. Thus, reaction in sulfur occurs at temperatures below substantial thermal decomposition of the crude shale oil.

Some type of mild rearrangement of the molecules in the crude shale oil is believed to be occuring, even at ambient temperatures, with sulfur released as hydrogen sulfide. Maintaining the oil at elevated temperature accelerates such rearrangements and speeds reduction of sulfur content. Loss of hydrogen sulfide from some petroleum oils and reduction of sulfur content of such petroleum oils is common enough to be called self-refining.

The actual process by which sulfur is removed from crude shale oil in accordance with practice of this invention can involve one or more of the above-mentioned mechanisms which are presented by way of illustration, or it can involve a different mechanism. Each of these results in evolution of hydrogen sulfide. It is believed that other non-condensible sulfur-containing gases can be evolved from the crude shale oil, such as mercaptans, carbonyl sulfide, thioethers, and other volatile sulfur compounds similar to those present in retorting off gas.

EXAMPLES

Several portions of a composite sample of crude shale oil from the above-mentioned Retort 3 having an initial sulfur content of 0.9 percent by weight were heated in a flask equipped with a water-cooled reflux condenser for periods of one hour and eight hours at various temperatures, and the sulfur contents of the liquid samples were measured after heating. Before the sulfur reduction test, the composite sample was placed in a rotary evaporator at 70° C. to remove water and the light ends of the shale oil. After drying, the water content of the crude shale oil was about 0.2% by weight.

Figure 2:
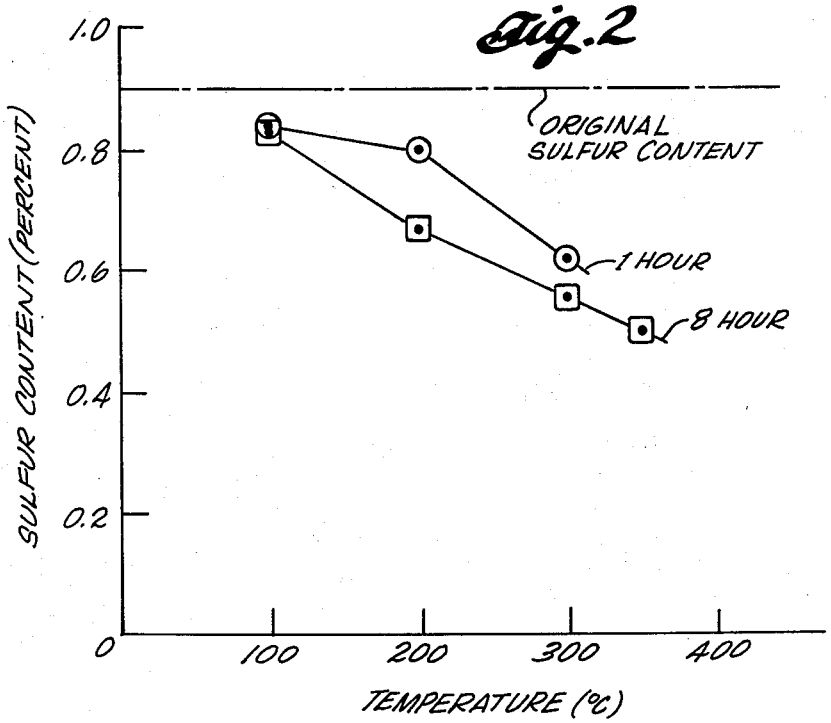

The results of the tests are illustrated in the graph of FIG. 2, which plots sulfur content of the shale oil in percent by weight as a function of the heating temperature for each of the two tests. The points plotted in circles represent heating for one hour and the points plotted in squares are for eight hours of heating. Upon heating at 100° C. for one hour the loss of sulfur is slight. At 100° C. about three times as much sulfur is lost in eight hours as is lost in one hour of heating. At 200° C., the loss of sulfur is more substantial, and again about three times as much is lost in eight hours as in one hour of heating. At, 300° C., about 1.4 times as much sulfur is lost in eight hours as in one hour of heating. Thus, at intermediate temperatures such as 200° C., the extent of sulfur removal is more strongly dependent upon the time of heating than at higher temperatures such as 300° C. Maintaining a sample of crude shale oil for eight hours at 350° C. lowered the sulfur content of the shale oil from 0.9 weight percent to about 0.43 weight percent, a reduction in sulfur content of more than 50 percent.

A composite sample of oil from Retort 4 had a sulfur content of about one percent when withdrawn from the in situ oil shale retort. A sample of this oil was stored under uncontrolled conditions for a period of over one year. During this time, self refining of the oil occurred, and an aliquot of the sample showed a sulfur content of about 0.52% by weight after storage. Such a sample of stored shale oil was heated and showed an initial boiling point of about 325° F. (163° C.). After about four hours of boiling, the boiling point gradually increased over the course of an additional four hours to about 530° F. (277° C.). During such boiling, nitrogen was bubbled through the shale oil. At the end of the eight hours of boiling, the sulfur content was about 0.50% by weight. Thus, little, if any additional sulfur was removed by such heating of self refined oil since the different sulfur contents measured before and after boiling is within the limits of analysis accuracy.

Self refining occurred in a number of samples of crude shale oil aged by maintaining the oil at uncontrolled ambient temperatures for periods of more than a year and a half. Under these conditions sulfur content of the crude shale oil changed as indicated in Table II. Some of the scatter in the sulfur content of the shale oil before aging could be due to uncontrolled sample handling preceding analysis.

TABLE II

| Sulfur Content Percent by Weight | | |
|---|---|---|
| Before Aging | After Aging | % Decrease |
| 1.08 | 0.73 | 32 |
| 1.16 | 0.81 | 30 |
| 1.64 | 0.79 | 52 |
| 1.24 | 0.72 | 42 |
| 1.00 | 0.72 | 28 |
| 1.00 | 0.62 | 38 |
| 0.96 | 0.61 | 36 |
| 0.92 | 0.52 | 43 |
| 1.24 | 0.55 | 56 |
| 0.96 | 0.55 | 43 |
| 1.04 | 0.53 | 49 |
| 0.72 | 0.56 | 22 |
| 1.20 | 0.54 | 55 |
| 1.16 | 0.53 | 54 |
| 1.16 | 0.53 | 54 |
| 1.04 | 0.54 | 48 |
| 1.24 | 0.55 | 56 |

In another test, a fresh sample of crude shale oil was boiled under reflux conditions for about 48 hours at about 320° C. The sulfur content was reduced from about 1.0% to about 0.57% by weight.

Two samples of fresh crude shale oil having an initial sulfur content of about 1.13% were maintained at a temperature of about 250° C. under reflux conditions for about eight hours. During heating, one of these samples had nitrogen gas bubbled through the sample, and the other sample had hydrogen gas bubbled through the sample. The sulfur content of the sample with nitrogen bubbling was reduced to about 0.72% by weight, and the sulfur content of the sample having hydrogen bubbling was reduced to about 0.68% by weight. This is not regarded as a significant difference between hydrogen and nitrogen bubbling since the difference in apparent sulfur content is near the limit of analysis accuracy. It is believed that bubbling of gas through the sample while it is maintained at elevated temperature helps remove non-condensible sulfur-containing gas from the liquid, thereby enhancing the rate of sulfur reduction. The hydrogen under these conditions does not react significantly with the crude shale oil.

The sample of shale oil heated with hydrogen bubbling was maintained at 250° C. with hydrogen bubbling for an additional 35 hours. The sulfur content of the sample after the total of 43 hours at 250° C. was about 0.63% by weight. This difference is barely significant and suggests that some additional sulfur was removed from the crude shale oil although most effective sulfur removal was completed when the oil was maintained at 250° C. for eight hours.

It is believed that a current of gas bubbled through the crude shale oil while it is maintained at elevated temperature enhances the rate of sulfur reduction by removing hydrogen sulfide or other non-condensible sulfur-containing gas from the liquid. Passing an inert carrier gas over the liquid can also be helpful. Bubbling a gas through the crude shale oil when it is near its boiling temperature has a limited effect on the rate of sulfur reduction. However, at lower temperatures, gas bubbling can significantly increase the rate. The rate of sulfur reduction can also be enhanced by stirring or agitating the crude shale oil or by forming the shale oil into a thin film or spray to increase its surface area and promote evolution of hydrogen sulfide or other non-condensible sulfur-containing gas.

The heating can be done under an inert atmosphere such as a blanket of nitrogen. A current of an inert carrier gas can be used to sweep evolved non-condensible sulfur-containing gas from the heating vessel.

The present invention has been described with reference to particular details and embodiments thereof, but numerous variations and modifications of the invention may be made within the scope of the appended claims. For example, crude shale oil can be reacted, in the substantial absence of added reagent, in the presence of a catalyst for evolving non-condensible sulfur-containing gas at a greater rate than obtained by heating in absence of a catalyst.

What is claimed is:

1. A method for producing crude shale oil of reduced sulfur content comprising the steps of:

forming a fragmented permeable mass of formation particles containing oil shale in an in situ oil shale retort in a subterranean formation containing oil shale;

establishing a combustion zone in the fragmented mass;

advancing the combustion zone through the fragmented mass by introducing an oxygen containing gas to the fragmented mass on the trailing side of the combustion zone and withdrawing an off gas from the fragmented mass on the advancing side of the combustion zone whereby gas flowing through the combustion zone transfers heat of combustion to a retorting zone in the fragmented mass on the advancing side of the combustion zone and wherein kerogen in oil shale in the retorting zone is decomposed to produce liquid and gaseous products, such liquid products including water and crude shale oil containing sulfur, such gaseous products being withdrawn in the off gas;

withdrawing liquid products from the fragmented mass on the advancing side of the retorting zone;

separating crude shale oil containing sulfur from such water; and maintaining separated crude shale oil at a temperature in the range of from about 100° to 400° C. in the substantial absence of added reagent for evolving substantially noncondensible sulfur-containing gas from such crude oil for a sufficient time to reduce the sulfur content of the crude shale oil.

2. A method as recited in claim 1 wherein the crude shale oil is maintained at a temperature above about 100° C. under reflux conditions.

3. A method as recited in claims 1 or 2 wherein the crude shale oil is maintained at a temperature above about 100° C. for a time in the range of from about 0.1 to 10 hours.

4. A method as recited in claims 1 or 2 wherein the shale oil is maintained at a temperature in the range of from about 200° to 350° C. for a time in the range of from about 0.1 to 100 hours.

5. A method for producing crude shale oil of reduced sulfur content comprising the steps of:

forming a fragmented permeable mass of formation particles containing oil shale in an in situ oil shale retort in a subterranean formation containing oil shale;

establishing a combustion zone in the fragmented mass;

advancing a retorting zone through the fragmented mass wherein kerogen in oil shale is decomposed to produce liquid and gaseous products, such liquid products including water and crude shale oil containing sulfur, such gaseous products being withdrawn in the off gas;

withdrawing liquid products from the fragmented mass on the advancing side of the retorting zone;

separating crude shale oil containing sulfur from such water; and evolving substantially non-condensible sulfur-containing gas from such crude shale oil by reacting the shale oil in the substantial absence of added reagent at temperatures below the thermal decomposition temperature of the shale oil for a sufficient time to reduce the sulfur content of the shale oil.

6. A method as recited in claim 5 wherein the crude shale oil is reacted by maintaining the shale oil at a temperature greater than about 100° C. under reflux conditions.

7. A method as recited in claims 5 or 6 wherein the crude shale oil is reacted by maintaining the shale oil at a temperature above about 100° C. for a time in the range of from about 0.1 to 100 hours.

8. A method as recited in claims 5 or 6 wherein the shale oil is maintained at a temperature in the range of from about 200° to 350° C. for a time in the range of from about 0.1 to 100 hours.

9. A method as recited in claim 5 wherein the crude shale oil is reacted by maintaining the shale oil at a temperature above about 100° C. until the sulfur content is reduced to about one-half percent by weight.

10. A method for reducing the sulfur content of crude shale oil from an in situ oil shale retort comprising the step of reacting the shale oil in the substantial absence of added reagent at a sufficient temperature to evolve substantially non-condensible sulfur-containing gas from such shale oil and below the thermal decomposition temperature of the shale oil for a sufficient time to lower the sulfur content of the shale oil.

11. A method as recited in claim 10 wherein the shale oil is reacted by maintaining the shale oil at a temperature in the range of from about 200° to 350° C.

12. A method as recited in claims 10 or 11 wherein the shale oil is reacted for a time in the range of from about 0.1 to 100 hours.

13. A method as recited in claim 10 comprising the step of substantially drying the shale oil before reacting, and reacting the shale oil by maintaining the shale oil above about 100° C.

14. A method as recited in claim 10 including bubbling a substantially inert gas through the shale oil for removing sulfur-containing gas from the shale oil.

15. A method as recited in claims 11 or 13 wherein the shale oil is maintained at temperatures in the recited range until the sulfur content is reduced to about one-half percent by weight.

16. A method for reducing the sulfur content of crude shale oil comprising the step of maintaining the crude shale oil at a temperature above about 100° C. in the substantial absence of added reagent, and below the thermal decomposition temperature of shale oil for a sufficient time to evolve substantially non-condensible sulfur-containing gas from such shale oil for lowering the sulfur content of the shale oil.

17. A method as recited in claim 16 wherein the shale oil is maintained at a temperature less than about 400° C.

18. A method as recited in claims 16 or 17 wherein the shale oil is maintained at a temperature above about 100° C. under reflux conditions.

19. A method as recited in claims 16 or 17 wherein the shale oil is maintained at a temperature above about 100° C. for a time in the range of from about 0.1 to about 100 hours.

20. A method as recited in claims 16 or 17 including bubbling a substantially inert gas through the shale oil while maintained at a temperature above about 100° C.

21. A method as recited in claim 16 wherein the shale oil is maintained at a temperature in the range of from about 200° to 350° C.

22. A method as recited in claims 16 or 17 wherein the shale oil is maintained at temperatures above about 100° C. until the sulfur content is reduced to about one-half percent by weight.

* * * * *